US006199502B1

(12) United States Patent
Mattson

(10) Patent No.: US 6,199,502 B1
(45) Date of Patent: Mar. 13, 2001

(54) CONCRETE MODULE FOR FLOATING STRUCTURES AND METHOD OF CONSTRUCTION

(76) Inventor: Jerry L. Mattson, 15 Old Erie Rd., Lake Ozarks, MO (US) 65049

( * ) Notice: Subject to any disclaimer, the term of this patent is extended or adjusted under 35 U.S.C. 154(b) by 0 days.

(21) Appl. No.: 09/384,095

(22) Filed: Aug. 27, 1999

(51) Int. Cl.[7] ..... B63B 35/44
(52) U.S. Cl. ..... 114/266; 114/267
(58) Field of Search ..... 114/65 A, 266, 114/267, 263; 405/219

(56) References Cited

U.S. PATENT DOCUMENTS

| | | |
|---|---|---|
| Re. 31,984 | 9/1985 | Sluys . |
| 3,091,203 | 5/1963 | Usab . |
| 3,128,737 | 4/1964 | Usab . |
| 3,546,773 | 12/1970 | Gerstin . |
| 3,799,093 | 3/1974 | Thompson . |
| 4,265,193 | 5/1981 | Sluys . |
| 4,318,361 | 3/1982 | Sluys . |
| 4,318,362 | 3/1982 | Jung . |
| 4,321,882 | 3/1982 | Sluys . |
| 4,365,914 | 12/1982 | Sluys . |
| 4,406,564 | 9/1983 | Hanson . |
| 4,693,631 | 9/1987 | McKay . |
| 4,709,647 | 12/1987 | Rytand . |
| 4,715,307 | 12/1987 | Thompson . |
| 4,887,654 | 12/1989 | Rytand . |
| 4,940,021 | 7/1990 | Rytand . |
| 4,947,780 | 8/1990 | Finn . |
| 5,044,296 | 9/1991 | Finn . |
| 5,050,524 | 9/1991 | Kyhl et al. . |
| 5,107,785 | 4/1992 | Baxter . |
| 5,215,027 | 6/1993 | Baxter . |

*Primary Examiner*—Ed Swinehart
(74) *Attorney, Agent, or Firm*—Richard J. Grundstrom

(57) ABSTRACT

A concrete module having a buoyant center core with a light weight concrete outer shell. The modules have lengthwise and width wise passages on non-common planes which are above the water line when the modules are floated with weight. The modules are connected with rods, cables or other interconnecting method through the passages. The sides of the modules may be concaved to allow the modules to fit securely together in a straight line without bowing or bending. The top of the module is constructed with reinforcing ribs for strength. The size of the modules are designed to be transported using standard hauling trucks and moved with skid loaders or fork lifts. The modules have common sizes and connecting passages between modules to make uniform modules to allow custom designed docks and other floating structures to be configured. A variety of brackets are provided for attaching items to the modules making up the floating structure.

26 Claims, 9 Drawing Sheets

CONCRETE MODULE FOR FLOATING STRUCTURES AND METHOD OF CONSTRUCTION

BACKGROUND OF THE INVENTION

The present invention relates to a concrete module for floating structures and a method of constructing the structures and the modules.

Floating structures, such as docks, decks, wharfs, breakwater, floating walkways, boat slips and other structures, have been in existence and in use for numerous generations. Many generations ago these type structures were made typically with wood. In more recent times, there a number of different materials and different construction technics known and used. This invention is centered around floating structures, and more particularly to modules that can be used to make floating structures, a means to interconnect the modules and a method of constructing the modules.

There are several different type of concrete floats or modules known in the art and in use. There are various advantages and disadvantages to each. Several of these known modules are made with an outer layer of concrete over a center hollow area or center float. There are also various methods of connecting the modules depending on the particular use and the particular features and design of the modules. There are modules that are connected using upper and lower connecting means, such as cables or chains. These type generally have tubes or opening through the modules for the connecting cables. However, these typically have the lower connecting means under the water level when the modules are in use. This arrangement creates several different problems. First, there is the problem of working under water to connect the modules. Then once connected, the cables being under water, often rust, especially if used in salt water, and result in broken cables. This arrangement also requires a high degree of maintenance. This arrangement also requires at least four separate connecting means for each direction of interconnecting the modules. This can result in high expense for construction, material and assembly. This invention overcomes these problems and disadvantages.

Another type of module only have connecting means along the top of the modules. Of this type there are two basic types. One has cables or rods that hold the modules tightly together along the top edge. This is accomplished by having openings or tubes just under the top surface. The problem is that the modules flex or bow in respect to each other. This also creates very high compression forces along the top edges. Docks and walkways using this method have broken edges in a relatively short time. One type of module tries to overcome this problem by incorporating flanges along the abutting edges. This allow the modules to flex in respect to one another. However, the structure is then made of many modules which flex and bow constantly. This is an undesirable structure most of the time, in that it can be difficult to walk upon during rough water or when several different people are walking on the structure at the same time. It feels like it is very unstable. This invention overcomes these problems.

Another method of making these floating structure, is to pour a concrete slab into forms positioned on top of modules positioned in the water. These structures are very stable in that they are constructed with a continuous concrete top surface. However, these type of structures are also very expensive and have arrangement limitations. Another method is to bolt the modules together using side rails or wharfs. These are effective, but the side rails are often made of wood, require high maintenance and are also relatively expensive to construct. Again there is limited arrangement capability using side rails. If one wanted to build larger structures or slips there are physical limitations which would have to be overcome. This invention again overcomes these problems and disadvantages.

The concrete modules having the connecting means on the top and bottom also have a problem with the modules abutting one another. During construction, concrete is often poured into forms to cover a center float with concrete. The weight of the concrete causes the forms to bow outward slightly. Then as the modules are joined or interconnected in the water, they contact each other someplace in the center of the module, rather than along the total surface. This creates spaces along the outer perimeter of the abutting modules. The outer most perimeters of the sides do not join. As the connecting means are tightened to make a rigid structure out of a plurality of modules, the modules bow because of the gaps along the bottom, sides and top. The bowing will be in the direction of which ever connecting means is tightened first or which ever one is the tightest. This creates a very uneven surface and creates undue stress in the connecting means and along the abutting surfaces. In addition, if a connecting means break, due to being submerged under water or otherwise, the modules immediately bow. Openings or spaces are created along the top surface where the modules abut. To overcome these problems the openings or cracks are often filled with concrete or wooden wedges. These are unsightly, creates hazards, and are a high maintenance item. This invention overcome this disadvantages.

Several of the known modules are also constructed and designed to be configured in one and only one configuration. The configuration could be a straight walkway or dock, a dock with boat slips or some sort of breakwater. Generally, the means of connecting the modules, along with the size and shape determine the configuration. The configuration can not be altered beyond a limited design. This invention allows virtually any configuration that can be conceived without modification of the modules, making it a universal module for floating structures.

Since the modules are capable of being interconnected in virtually any configuration, the ability to expand or alter the configuration at a later date is provided. Virtually all of the prior art, once the structure is constructed, can not be easily expanded upon nor can the configuration be easily altered. This invention overcomes these problems.

Several of the modules of the prior art have metal liners or tubes embedded in the concrete to provide passages through the module for the interconnecting cable, chain or rod. The metal liners often rust and react with the interconnecting means. Electrolysis can also occurs due to the different metals of the liners and the interconnecting means. Both the rust and the electrolysis cause the cables, chains or rods to weaken and break. This invention eliminates this undesirable feature.

Often docks, boat slips and other floating structures needs a method of attaching various things or items to the structure. Stabilizing cables are attached to docks and boat slips to prevent the dock from wondering and moving out of position. Approach ways, ramps, or walkways from the shore to the dock are often used and which often require a pivoting attaching method to compensate for various water levels. Buildings and roofs are also added and used. Cleats have to be added for securing boats. Brackets of one sort or another have to be added for attaching rails. Cleats to tie boats to are often added. All these and other items have to be attached to the floating structures made with the modules. Most of the modules of the past had no specific method available. It was up to the contractor to design and install a suitable method. The features of the module of this invention makes attaching any item a simple task. The problems of the past are overcome.

Patents for modules of the prior art discussed the ability to construct the modules at the site of installation as an advantage. This was considered desirable because of the size and weight of the concrete modules. The size and weight made it difficult to move and transport the modules. However, site construction results in less quality control, unpredictable weather conditions and unknown time table. The module of this invention overcomes these disadvantages. The modules can be uniformly constructed and easily shipped by truck.

Accordingly, it is an object of the present invention to provide a concrete module and a method of constructing the modules, in which a plurality of modules can be easily assembled in a variety of different configurations to form floating structures. With the concrete module for floating structures and method of construction of this invention it has been found that the modules can be configured to form a water break, wharf, walkways, docks, and other structures of various widths and lengths, including docks with one or more boat slips extending therefrom, without any modifications to the modules. Thereby, making this module a universal module for virtually any type of floating structure.

Another object of the present invention is to provide an improved concrete module for floating structures and a method of constructing the modules that provides modules with concave side surface without an outward bowing to provide modules that will accurately abut one another when joined or interconnected with another module. This feature provides a means of making a very flat and even structure, and which also provides a very stable structure in rough water or when in use by many people.

A further object of the present invention is to provide a concrete module for floating structures and method of construction adapted to provide a module that can be constructed at a relatively rapid rate under controlled conditions to make a very high quality module which is also transportable. The module of this invention is designed and constructed such that the modules are uniform in size and weight and are easily handled by a fork lift or skid loader. This makes the modules transportable to the site and easily handled with common machinery.

Still another object of the present invention is to provide a concrete module for floating structures and method of construction that allows a plurality of modules to be easily interconnected to one another by an interconnecting system which is easy to assemble, requires little maintenance if any, eliminates or reduces rust and electrolysis problems which can cause deterioration of the interconnecting means, and reduces labor and material cost in interconnecting the modules. The concrete modules for floating structure of this invention are interconnected by a pair of interconnecting means along a plane which is above the waterline. The modules are designed such that the modules abut one another and are held securely together by a pair rather than by four interconnecting means or by side rails or wharfs.

Still a further object of the present invention is to provide a concrete module for floating structures and method of construction that provides for attaching various other items, structures, or objects to the assembled modules or floating structure. The concrete module for floating structures and method of construction of this invention is characterized by a plurality of attachment brackets that are simply installed as desired as the floating structure is being assembled. As such a variety of different attaching brackets are provided.

To accomplish the foregoing and other objects of this invention there is provided a concrete module for floating structures and method of construction and more particularly to a concrete module used in the construction of docks, swim platforms, walkways, slips and other floating structures and a method to construct the modules.

SUMMARY OF THE INVENTION

The concrete module for floating structures and method of construction of this invention includes a concrete module having a buoyant center core with a light weight concrete outer shell. The light weight concrete typically is made with an expanded shale aggregate for lightness and strength. The modules typically have length wise and width wise passages on non-common planes which are above the water line when the modules are floated with weight. The modules are connected with rods or cables through the passages. The sides of the modules may be concaved to allow the modules to fit securely together in a straight line without bowing or bending. The top of the module is constructed with reinforcing ribs for strength. The size of the modules are designed to be transported using standard hauling trucks and moved with skid loaders or fork lifts. The modules have common sizes and connecting passages, and are therefore uniform to allow custom designed docks and other floating structures to be assembled without modification.

The above mentioned and other objects, and features of the present invention will be better understood and appreciated from the following detailed description of the main embodiment thereof, selected for purposes of illustration and shown in the accompanying drawings.

DETAILED DESCRIPTION

Figure 1:
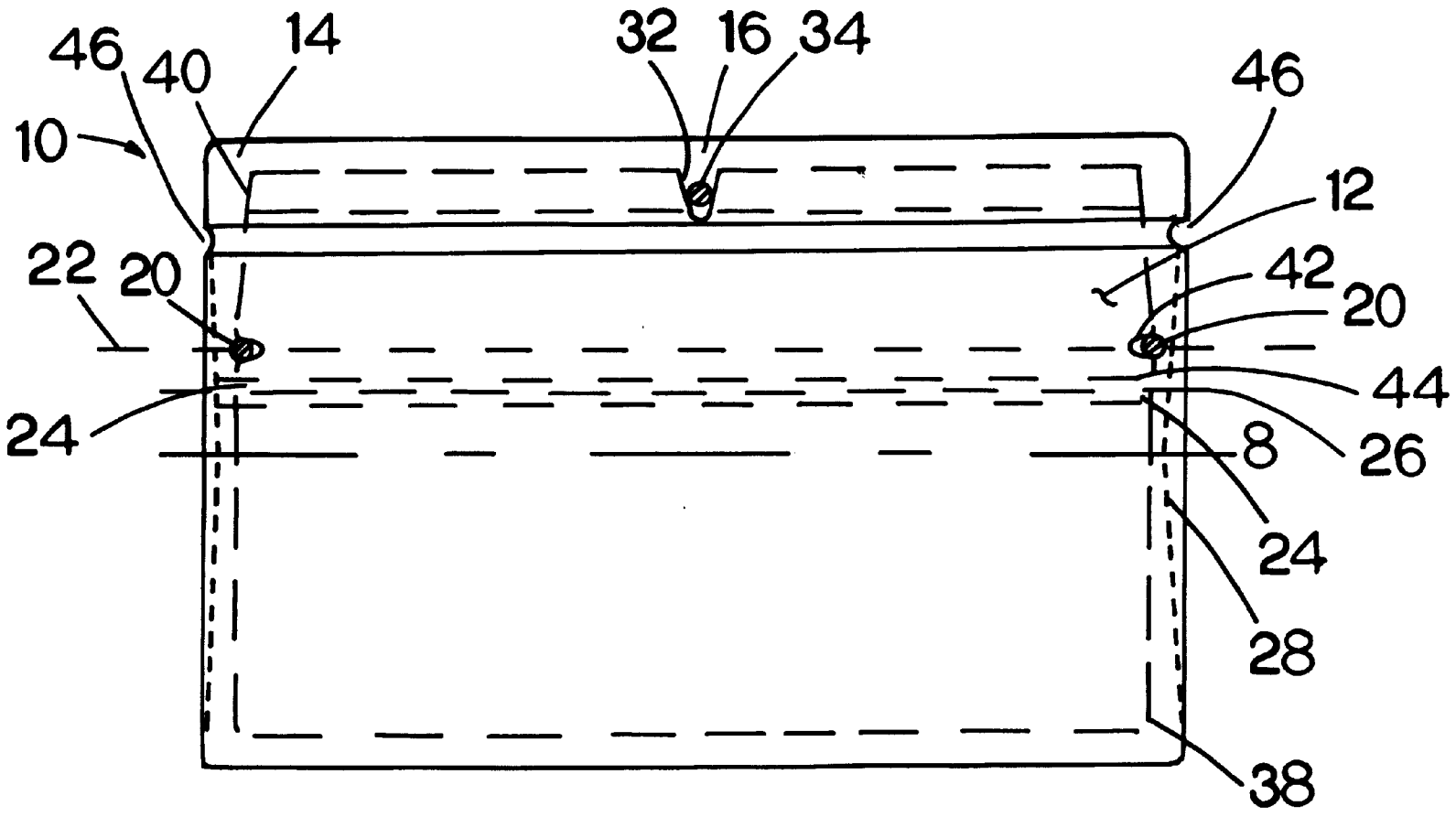
FIG. 1 is a side view showing the concrete module of this invention and the center buoyant core.
Figure 2:
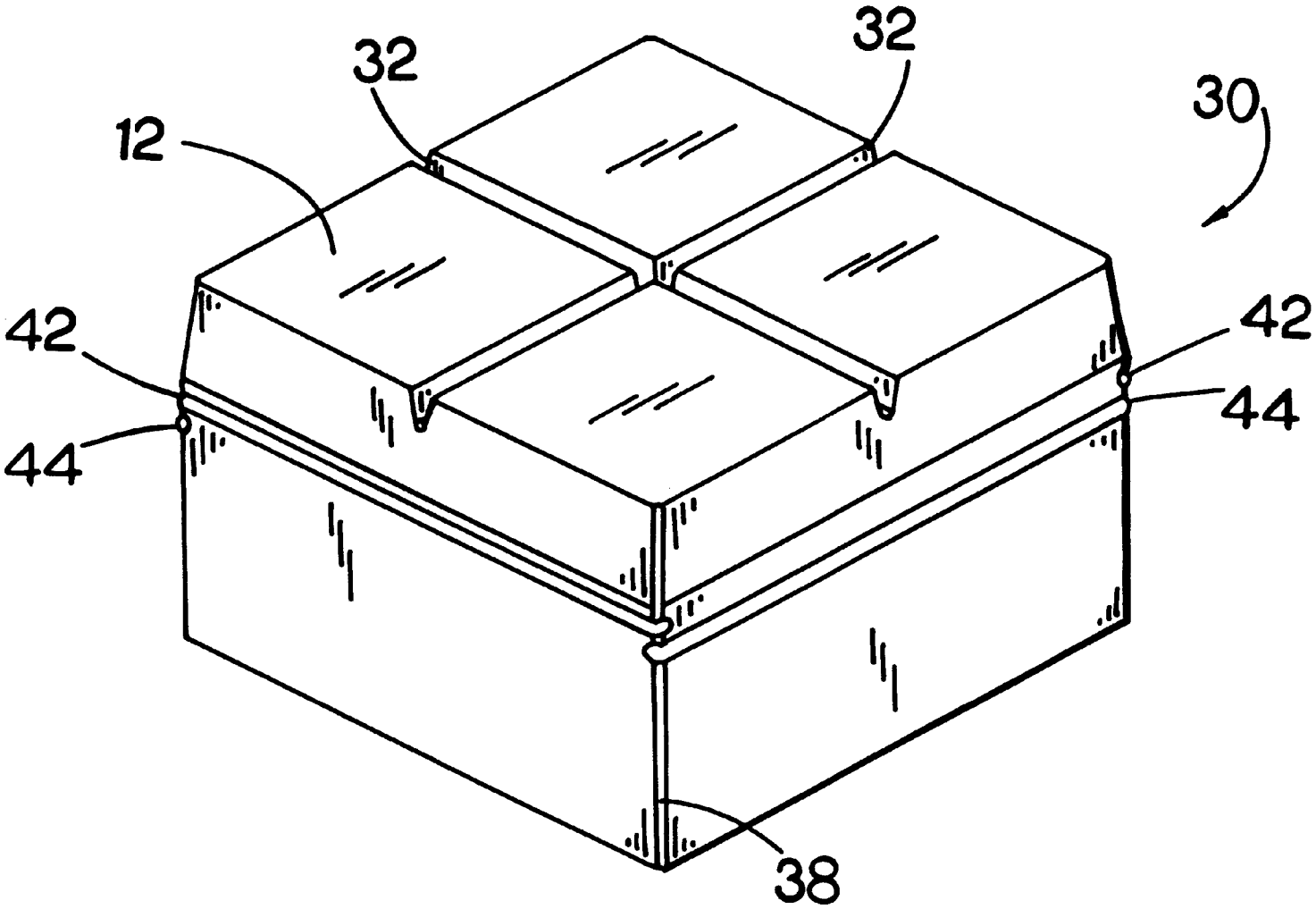
FIG. 2 is an isometric view showing various features of the buoyant core for the concrete module of this invention.
Figure 3:
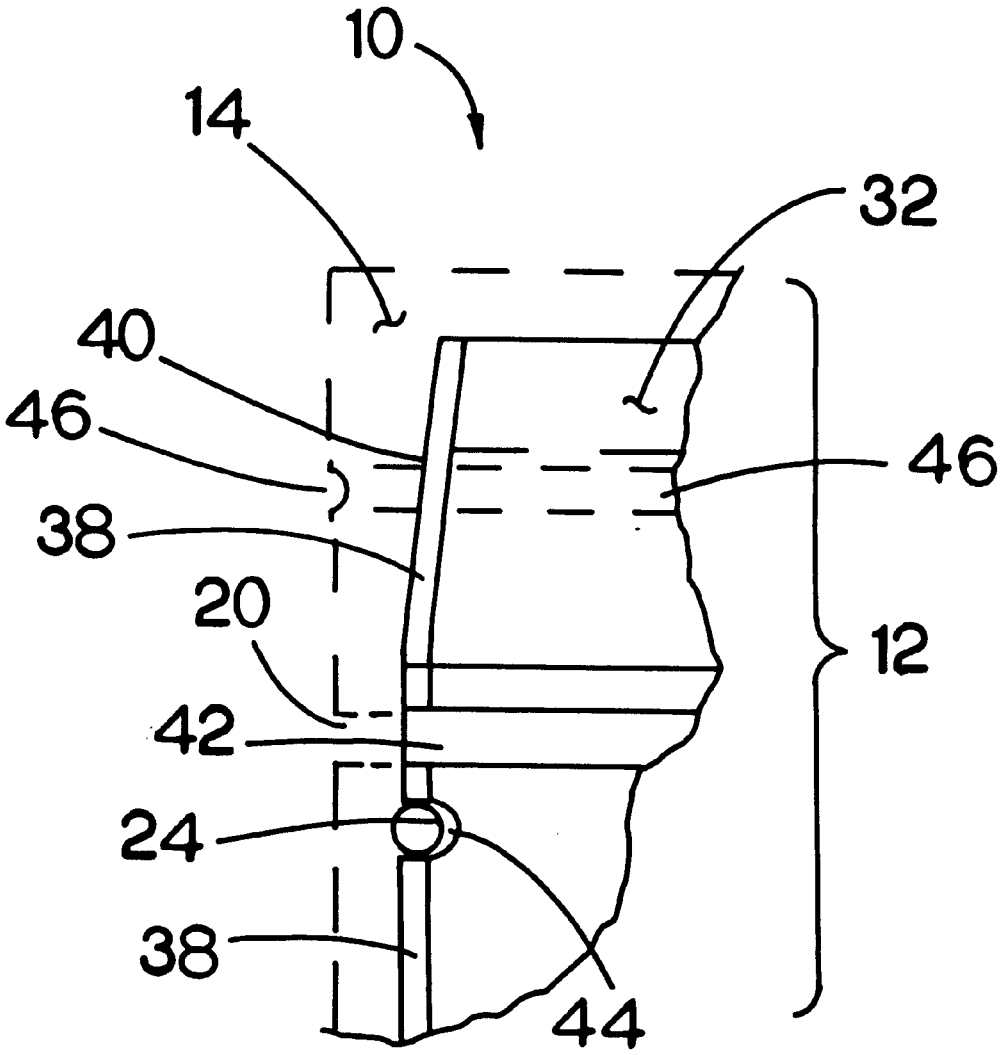
FIG. 3 is a corner detail showing the notches, chamfered corners, and tapered upper portion.

Referring now to the drawings there is shown a preferred embodiment for the concrete module for floating structures and method of construction. The preferred embodiment as shown and described is also considered the best mode contemplated.

The invention, in a very basic description, includes a module 10 having a buoyant center core 12 with a light weight expanded shale or light weight concrete outer shell 14. The module 10 has lengthwise and width wise passages on non-common planes which are above the water line 8 when the modules 10 are floated with weight. A plurality of the modules 10 are connected with an interconnection means such as rods or cables through the passages. The sides of the modules may be concaved to allow the modules to fit securely together in a straight line without bowing or bending. The top of the module is constructed with reinforcing ribs for strength. The size of the modules are designed to be transported using standard hauling trucks and moved with skid loaders or fork lifts. The modules have common sizes and connecting passages and are uniform to allow custom designed docks and other floating structures.

The preferred embodiment and the best mode contemplated of the concrete module floating structure and method of construction of the present invention are herein described. However, it should be understood that the best mode for carrying out the invention hereinafter described is offered by way of illustration and not by the way of limitation. It is intended that the scope of the invention include all modifications which incorporate its principal design features.

The concrete module 10 generally has a buoyant core 12, a concrete shell 14, reinforcing ribs 16 under the top surface 18 of the concrete shell 14, a first passage or passages 20 along a first plane 22, and a second passage or passages 24 along a second plane 26. One or more sides 28 of the module 10 may be concaved to allow the modules to abut one another. The modules 10 are designed such that a plurality of the modules 10 are interconnected to form a floating structure.

The buoyant core 12, in the preferred embodiment, is made or formed from a block of expanded polystyrene 30. This is the preferred method but other materials or configurations could also be used. It is preferred because the expanded polystyrene will displace water, will not allow any water within the buoyant center region within the center of the concrete shell 14, and is generally water resistant in that it will not absorb water nor deteriorate due to water exposure. A hollow center, such as a hollow plastic block or other similar structure and arrangement, could also be used. The critical feature being that the center core be buoyant and structurally arranged to be covered with a concrete shell 14.

The overall dimensions of the basic module 10 in the preferred embodiment is 48 inches by 48 inches. Other dimensions and other shaped modules are also considered within the scope of this invention as long as all the inventive features are included therein. Since the basic module 10 is 48 inches by 48 inches the buoyant core 12 would have a smaller dimension. In the preferred embodiment, the concrete shell 14 has side thickness of approximately 1½ inches. This would make the dimensions of the buoyant core 45 inches by 45 inches.

The height of the buoyant core 12 may vary depending on live weight and or dead weight at the particular location of the module 10 in the overall floating structure 6. The buoyant core 12 provides the buoyancy needed to float the entire module 10 along with any other live and/or dead weight such as people, roofs, snow, ice, buildings, and other items and objects. Generally, the greater the height of the module 10 the more buoyant the module 10. As such, the particular location of the module in the floating structure may determine which height module 10 will be used.

A general purpose module 10A, which is the primary module used throughout constructing most of a floating structure, has a height of approximately 30 inches. In locations where buildings, posts for roofs, or any other object exerting above average weight on a continuous basis are located, modules 10C with heights greater than 30 inches may be used. These type of locations require a higher degree of floatation due to the greater than average weight. Without the greater height additional stresses are placed on the interconnecting means 50 to distribute the weight to adjoining modules 10. It is the plurality of modules 10 interconnected together that provides the stability and the desirable features of a floating structure 6.

It has been found that the increased height of the buoyant core 12 and module 10C provides extra floatation to support the added weight, which in turn relieves stress on the interconnecting means and the adjoining modules 10. The basic module 10A has an overall height of approximately 30 inches, thus the height of the buoyant core 12 is approximately 27 inches high. The overall height of the module 10C, providing the additional floatation, may be 34 inches, with a buoyant core 12 of approximately 31 inches. The exact measurement may and will probably vary depending on the particular application, type of materials being used, the configuration of the modules 10 in the floating structure and the degree of buoyancy needed for the weight. Again, this is the preferred embodiment and best mode contemplated. The exact measurements may vary.

The basic module 10 is generally rectangular in shape. Other shapes are also considered within the scope of this invention. A triangular shaped module 10B is provided for interior corners. These are used to reinforce and add strength to the overall floating structure 6. In addition, the triangular shaped modules 10B, when used in pairs at the beginning of a boat slip, can be used to form a boat bow receiving area. This reduces the open area along the front of a boat when docked in the slip. These other shaped modules 10 have all the features of the basic module 10. The only difference is the number of sides.

A smaller module 10 (not shown) will also be generally available. The smaller module would have exterior dimensions of approximately two foot by two foot or two foot by four foot. These smaller modules are used to configure different shape floating structures 6 that may require these sizes.

The buoyant core 12 has at least two notches 32 in a top surface of the block 30, again in the preferred embodiment. Additional notches 32 could be added as desired or as determined necessary. The notches 32 receives reinforcing rods 34 and are then filled with concrete to produce reinforcing ribs 16. These will be described in more detail further in this description. In the preferred embodiment, at least two of the notches 32 will be generally perpendicular to one another such that they cross somewhere in the center of the top of the module 10. The notches 32 in the buoyant core 12 are sized approximately 2 inches wide at the top, 2 inches deep and taper to 1 inch at the bottom of notch 32. The requirement of the notches 32 are to receive the reinforcing rods 34 and concrete to form the reinforcing ribs 16. As such, the exact dept and width of the notch 32 and the number is not the inventive feature.

The buoyant core 12, in the preferred embodiment, has chamfer corners 38 and a tapered upper portion 40 along the sides of the buoyant core 12. The chamfer corners 38 and tapered side portion 40 provides additional thickness of concrete at these location. The additional thickness of the concrete adds extra strength and durability of the concrete shell 14 along the top perimeter and at the corners.

The buoyant core 12 has grooves 42 and 44 along the sides of the buoyant core 12. The grooves 42 and 44 provide a path for forming the first and second passages 20 and 24, which are later explained. All the grooves (42 and 44) are parallel to the top surface of the module 10. In a four sided module 10, there would be four grooves, one on each of the four side. Groove 42 along with the groove on the opposite side, also referenced as 42, define a first plane 22. This plane is parallel with the top surface of the module 10 and positioned above the waterline 8. The groove 44 and the groove on the opposite side, also referenced as 44, define a second plane 26. The second plane 26 is parallel to the top surface of the module 10 and the first plane 22 and is also located above the waterline 8. The first plane 22 and second plane 26 are parallel and are considered non-common planes which do not intersect. Both are above the waterline 8.

The position of the first plane 22 and second plane 26 are uniformly positioned below the top surface on all modules 10. This feature provides uniformity between modules 10 so that they can be interconnected in a variety of configurations. This feature combined with the uniformity in length and width provides a uniform module 10 to construct virtually any type of floating structure using the modules 10 of this invention.

Since planes 22 and 26, along with the passages 20 and 24, are above the waterline, problems associated with the interconnecting means 50 being under water are eliminated.

Once the buoyant core 12 has been provided as described above, the buoyant core 12 is covered with a light weight reinforced concrete shell 14. The method of constructing the module 10 and the concrete shell 14 is later discussed. The buoyant core 12, in the preferred embodiment, is covered with 1½ inches of reinforced lightweight concrete on all surfaces with the thickness being greater at the location of the chamfered corners 38 and tapered upper portion 40.

In the preferred embodiment, the concrete will be of a light weight variety. Several different types of light weight concrete are known which are acceptable for use. Expanded shale aggregate has been in use in ship building since world war I and has been in general use for light weight concrete from around 1928. The expanded shale aggregate provides a very high quality and very strong aggregate to produce a relatively light weight concrete. As such this is the preferred aggregate for the light weight concrete used to form the shell 14.

There are also various methods of reinforcing concrete known and available. Reinforcing ranges from the use of reinforcing rods, metal screen or woven wire, to fiberglass meshes and various types of fibers being added to the concrete. Of the various methods available, several would function in accordance with the inventive features of this invention.

In the preferred embodiment, the light weight concrete used to make the concrete shell 14 will be made with a light weight expanded shale and reinforced with a fibrillated fiber made with polypropylene. The expanded shale and the fibers provides a very strong and light weight concrete. In addition, the polypropylene fibers are water resistant and will not rust or deteriorate when exposed to water for long periods of time. This is a very desirable feature, since the concrete is used and placed in the water.

The overall weight of the module 10 determines the buoyancy of the module 10. The weight also determines the location of the waterline 8 on the module and amount of weight the module can support. Therefore, a very strong and light weight concrete is desired and considered the preferred embodiment.

The concrete module 10 of this invention and the floating structures made with concrete modules, are very stable in rough waters. This is due to the weight of the module and overall size of the structure. Heavy weighted modules, such as the concrete module 10 of this invention, are not bounced around as much as a lightweight plastic shell modules which are also available on the market. And when used with a plurality of interconnected modules 10, the floating structure 6 becomes very stable in rough water. The floating structure 6 will not rock and roll as much as a light weight floating structure, and as such the concrete module 10 of this invention is preferred and has many advantages over the light weight variety.

Typically, reinforcing rods 34 may be positioned in the notches 32 prior to the concrete shell 14 being poured over the buoyant core 12. Any type of reinforcing rods 34, that provides adequate strength, would function in this capacity. In the preferred embodiment, a standard metal reinforcing rod ⅜ inches in diameter and cut to a length just slightly shorter than the length of the notches 32 is used. The notches 32 containing the reinforcing rods 34 and filled with concrete, forms reinforcing ribs 16. The reinforcing ribs 16 are totally integrated and formed with the concrete shell 14 and more particularly are positioned within the top surface of the module 10.

The reinforcing ribs 16 provide strength for the top surface. Since the typical modules 10 are four foot across the reinforcing ribs 16 provide significant strength to prevent the concrete from breaking under heavy weight. Any number of reinforcing ribs 16 could be added. However, as discussed above, the preferred embodiment contains two reinforcing ribs 16 which are generally perpendicular to one another. This has been found to be adequate for most situation and applications. The smaller modules and the triangular module may have a slightly different arrangement due the size and shape. The smaller module may not have nor require this feature.

The modules 10 are designed and constructed to be used with a plurality of the modules interconnected to form a floating structure 6. The floating structure 6 built with the modules 10 of this invention makes a flat rigid structure with a very high degree of stability. In order to provide such a structure, the modules 10 must fit together properly and tightly. There can not be openings between the modules nor can the modules be allowed to flex or bow in relation to one another. Most of the prior art could not provide this feature, as provided with this invention. Inventive features which provide this capability include the concaved surface 28, the interconnecting means 50 and the location of the non-common planes 22 and 26.

During construction of the module 10, the concrete shell 14 may be formed with a slight concavity on the side surfaces which would abut another module 10. Typically in the past, modules have been constructed with a slight convex surface. This was due to the weight and pressure of the concrete on the center of the forms. As the concrete was poured into the forms, the form would bow outward creating the convex surface. When the convex surface joined together on abutting modules there would be gaps and openings between modules. This creates hazards on the walking surface, modules which would bow and flex in relation to one another, and place great tensions on the interconnecting means. Typically, in the past the gaps at the top surface were filled with concrete or wooden wedges. Both which are unsightly and costly to install and maintain and create hazards when broken or damaged. The concave surfaces 28 of the module of this invention overcomes this problem.

The concave surface 28 on one or more sides of the modules 10 allow an outer perimeter area of abutting sides of one module to butt against an outer perimeter area an adjoining module. The center area on abutting modules do not contact one another. This completely eliminates any gaps between abutting modules 10. The specific means of constructing the modules 10 is later discussed.

The passages 20 and 24 can be basically described as openings through the modules 10. There is no metal liner or tube of any sort within the passages as used in the past. The purpose of no metal liners or tubes is to eliminate electrolysis between dissimilar metal, elimination of corrosion within the passages and elimination of any possible reaction between the interconnecting means 50 and a metal liner or tube.

As indicated herein, one or more of the first passages 20, in the first plane 22, receive a first interconnecting means 50 for joining a plurality of modules 10 in a line. The first plane 20 is below and parallel to a top surface of the top of the module 10 and above a water line 8 when the module is floated in water. One or more of the second passages 24, receive a second interconnecting means 50 to join abutting modules along a second side of the line of modules connected with the first interconnecting means 50. The first passages and second passages are in a general perpendicular relation to one another.

The passages could possible be bored through the module, but in the preferred embodiment, the passages 20 and 24 are made during construction and forming of the concrete shell 14. Forms are used in the preferred embodiment, to make and form the concrete shell 14. This will be later explained. The preferred method of forming the passages 20 and 24 is to use a metal rod positioned in the forms at the desired location of the passages 20 and 24. This location will generally correspond to the location of the grooves 42 and 44 along the sides of the buoyant core 12. The rods are positioned before the concrete is poured and extend outward from the outside of the forms. One the concrete is poured and set, the rods are removed from the module being formed. As the rods are being removed, they can be rotated and pulled back and forth to smooth the inside surface of the passages. The smooth surface is desired to prevent erosion of the interconnecting means 50 due to rough surfaces. The rod acts as a concrete trowel as it is being rotated and pulled back and forth. This method of construction leaves no metal liner or tubes of any sort as used in the past.

Typically, a passage forming rod having an outside diameter of 1 and 1/16 inch is used. This provides a passage 20 and 24 having an opening of approximately the same diameter. As such, an interconnecting means 50 of up to approximately 1 inch in width can be readily used to connect the modules 10.

The interconnecting means 50 is used to connect a plurality of modules 10 together to form a floating structure 6. The interconnecting means 50 can be rods, cables, chains or similar connecting apparatus or device. In the preferred embodiment, rods 52, with threaded ends, are used. These are preferred because they add rigidity to the structure, can be made in any length on location or at the factory, generally do not stretch as does a chain or cable when under tension for long periods of time, and any excess can be readily and easily trimmed. Typically, steel rods 52, or interconnecting means 50, of the desired length are inserted through the passages 20 and 24 on the modules 10 to be interconnected. A nut 54 is screwed onto one of the threaded ends. The modules 10 are then positioned tightly against one another and against the nut 54. A second nut, also referenced as 54, is then screwed onto the other threaded end to place tension on the rod 52 and to hold the modules 10 tightly against one another. As all the interconnecting means 50 are secured and tightened the floating structure 6 becomes very rigid and very stable. Once the modules 10 are interconnected and the nuts 54 tightened any excess can be cut off using standard tools.

In accordance with the features of the module of this invention, the interconnecting means 50 are in non-common planes 22 and 26 above the waterline 8. Typically there are two passages 20 or 24 in each of the planes 22 and 26. Each of passage 20 and 24 would have a rod 52 or other interconnecting means 50. This arrangement places two rods 52 or interconnecting means 50 in each plane 22 and 26. It has been found that this arrangement and location of the interconnecting means 50 secures the modules 10 against one another without flexing and bowing. Because of the concaved surfaces 28, the modules contact one another evenly along the entire perimeter of the abutting surfaces. Since all the modules are uniform in size and with passages 20 and 24 all similarly located, the modules 10 become universal, in that they can be arranged in any order.

This arrangement of the interconnecting means 50 in non-common planes and located above the water line 8, in conjunction with the concave surfaces, overcomes a vast majority of the problems associated with the modules of the past. There is no flexing or bowing of modules in relation to one another, the modules 10 are held securely against one another with no cracks or openings between adjoining modules, there is no or little rusting or erosion of the interconnecting means 50 nor is there any electrolysis between dissimilar metals.

Figure 6:
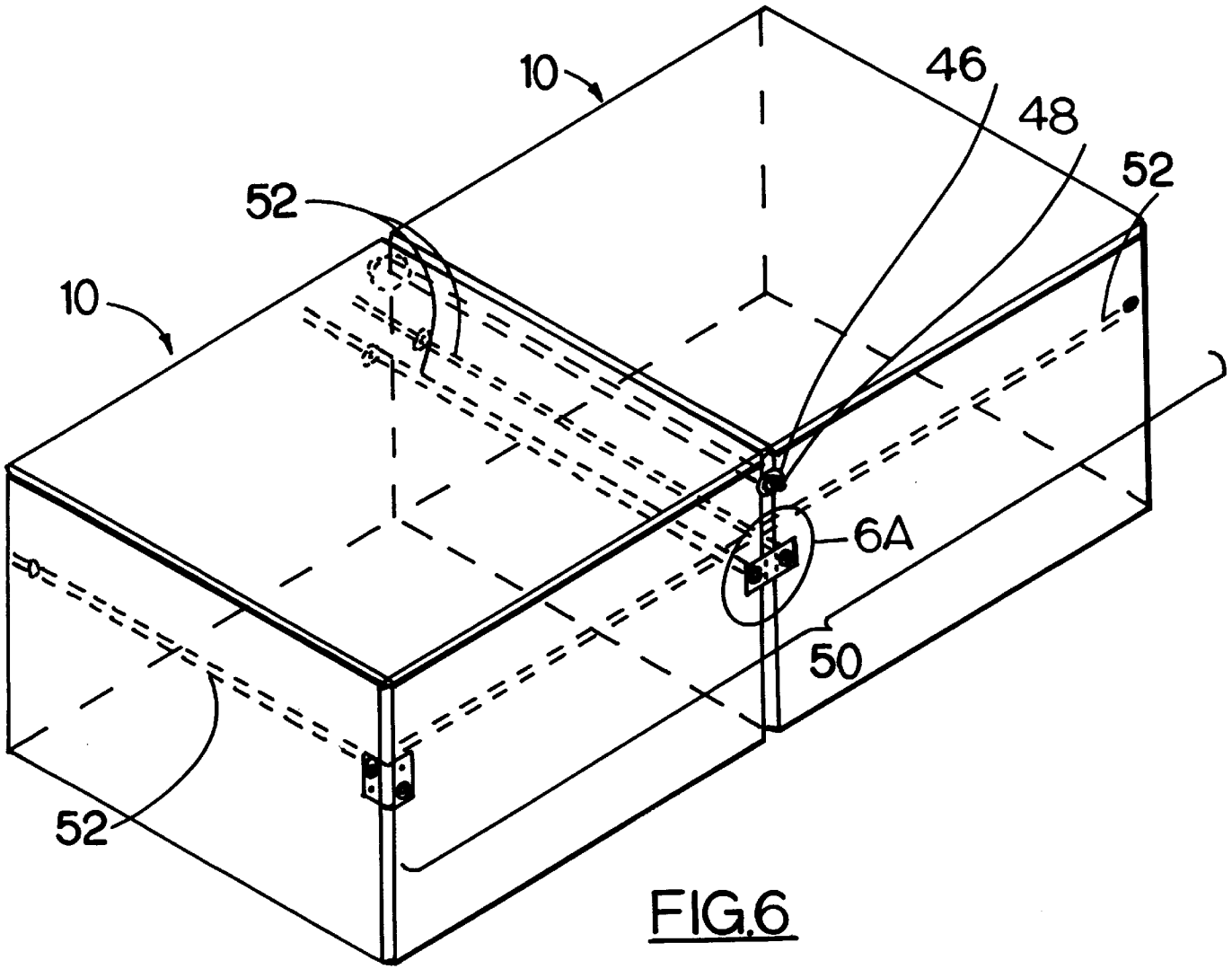
FIG. 6 show two abutting modules with a typical interconnecting means joining the modules together.
Figure 6A:
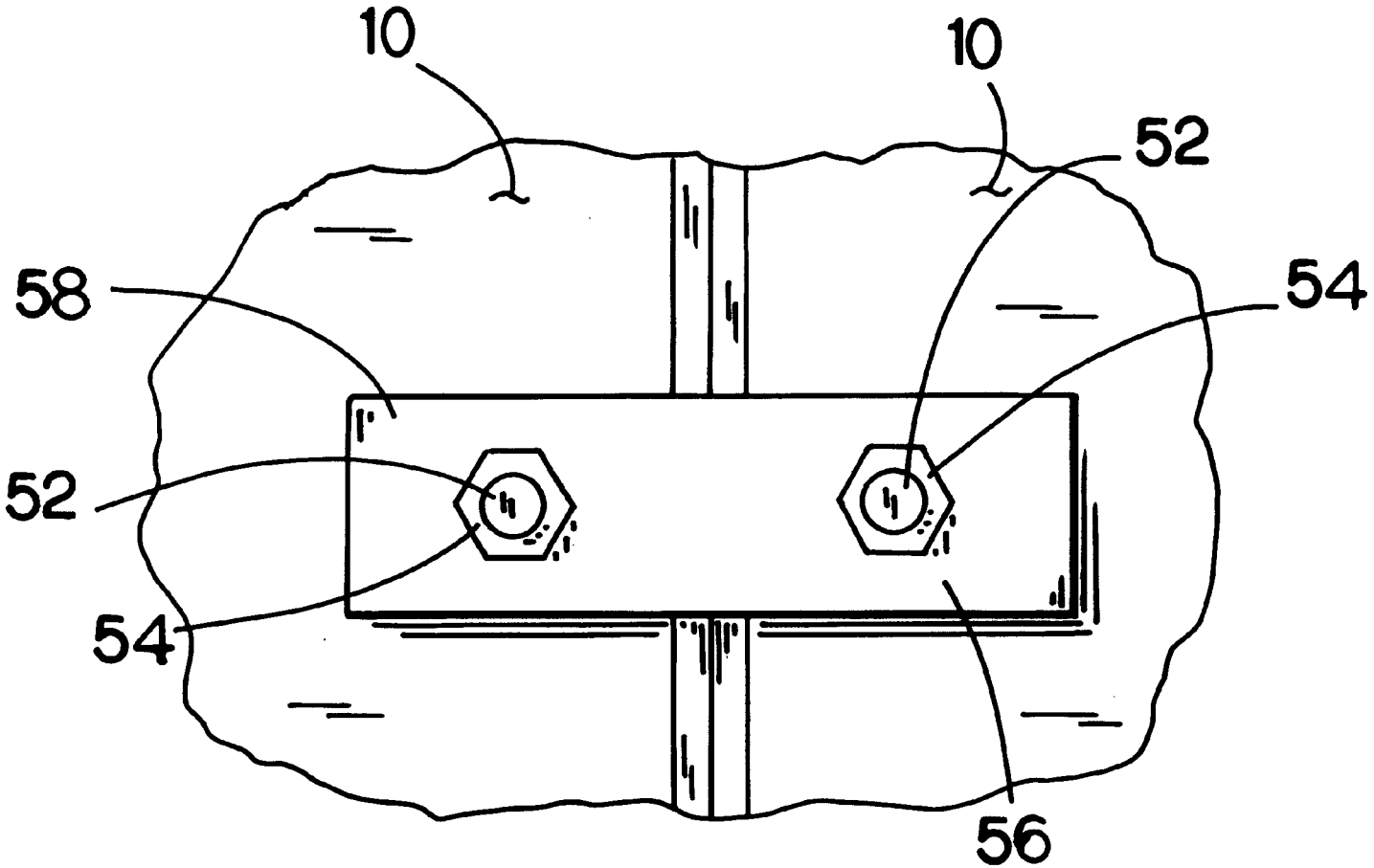
FIG. 6A shows a detail of a typical end of an interconnecting means.

A variety of brackets, generally referenced as 56, are provided. The brackets 56 are used for a variety of different purposes. One type of bracket 58 is used at the end of an interconnecting means 50, FIG. 6A. The bracket 58 is basically a rectangular plate having two openings which correspond to the location of passages 22 on adjoining modules 10. The plate provides several features. As the interconnecting means 50 is installed on the module 10, the bracket 58 is positioned over the end of the interconnecting means 50, or threaded rod 52. The nut 54 is then screwed onto the end of the rod 52. The plate provides protection to prevent damage to the concrete shell 14 from the nut 54. The bracket 58 also helps to secure adjoining modules together. The bracket 58 would be generally parallel in relation to the interconnecting means 50 on which the bracket 58 is not connected. This adds additional strength and stability at the intersection of two modules 10 and on the outside perimeter of the entire floating structure 6.

Figure 4:
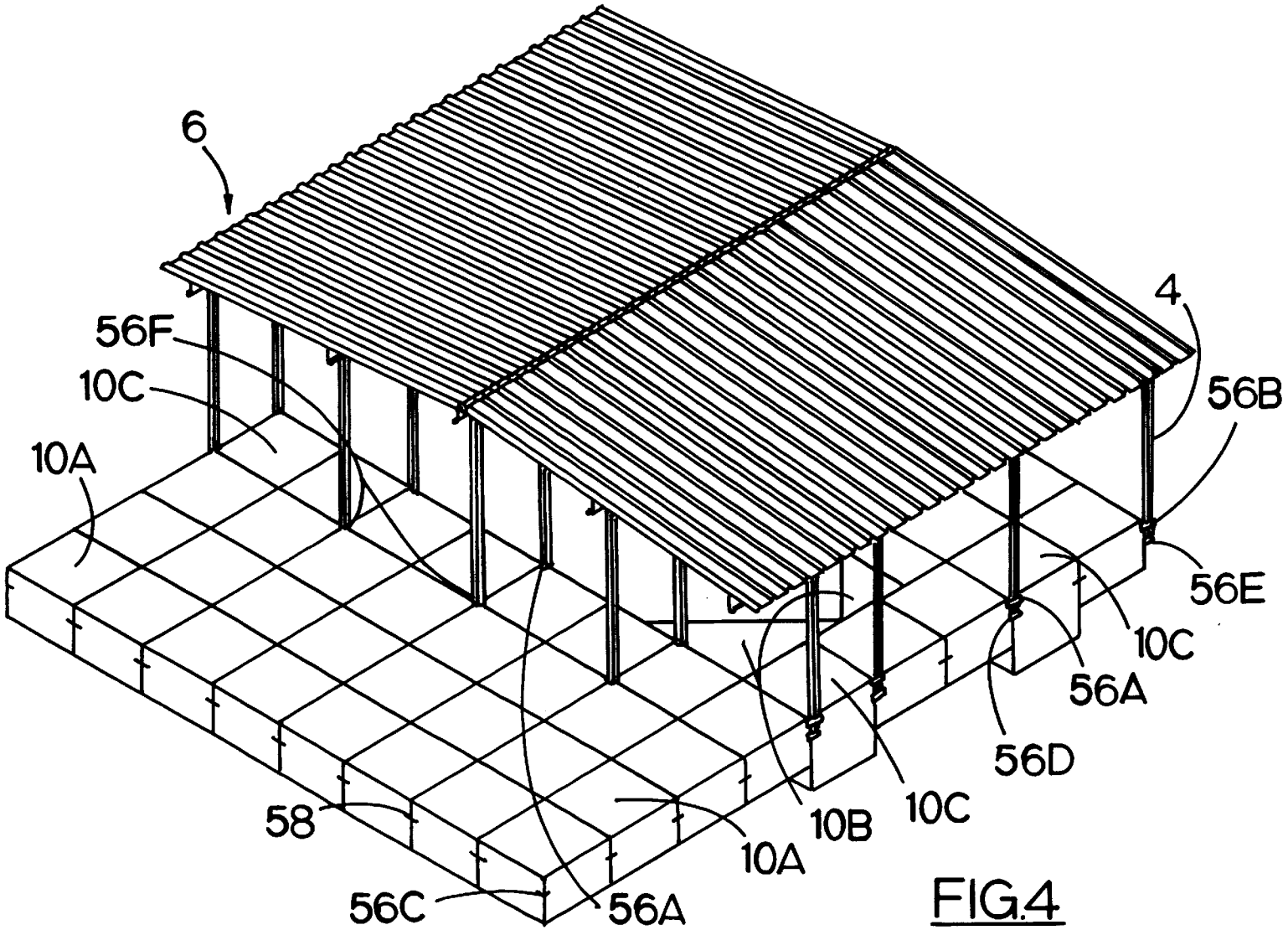
FIG. 4 shows one configuration of a floating structure made with the modules of this invention.
Figure 5:
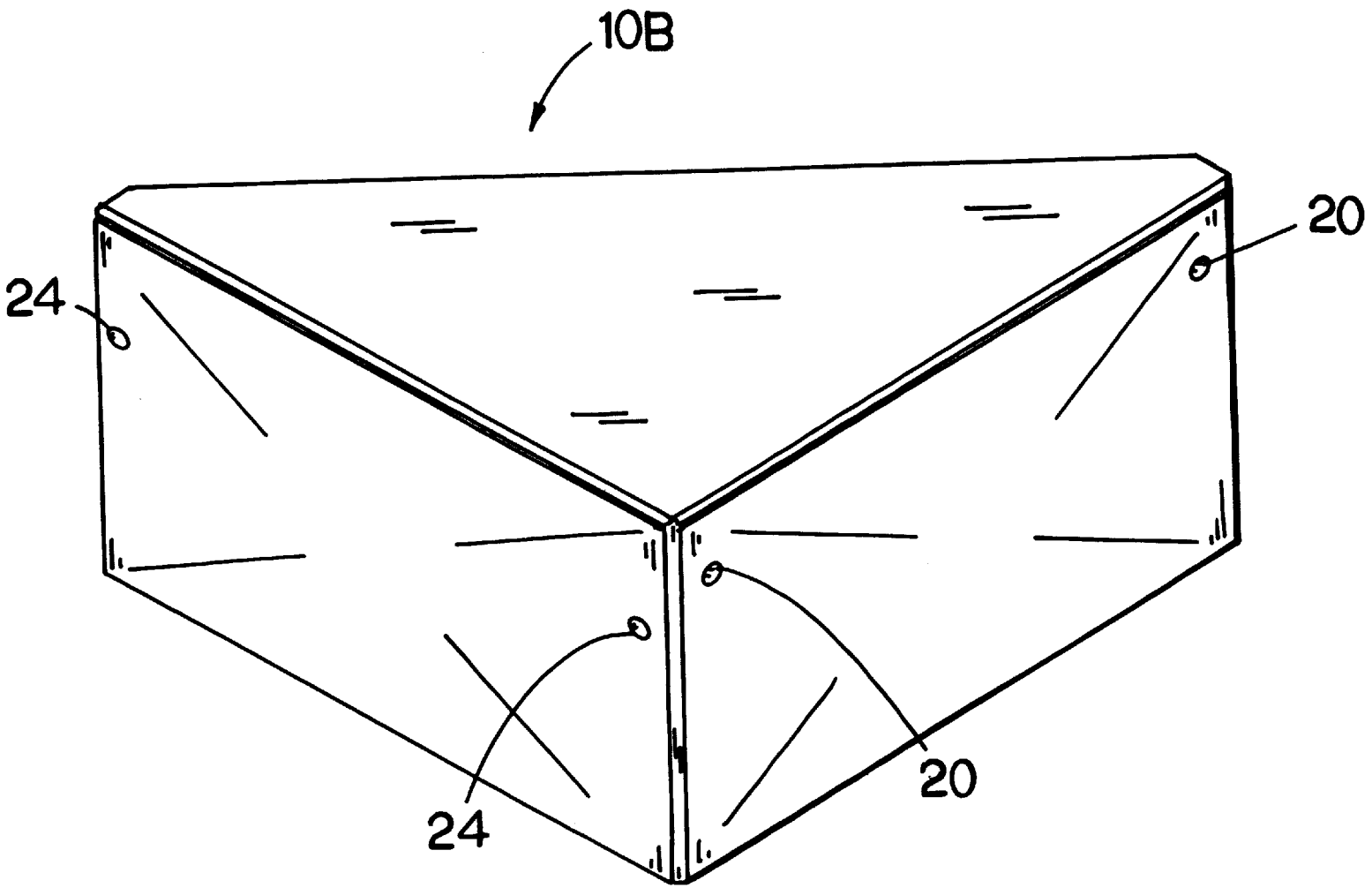
FIG. 5 shows a triangular shaped module of this invention, which is to reinforce interior corners and to form boat slips.
Figure 7:
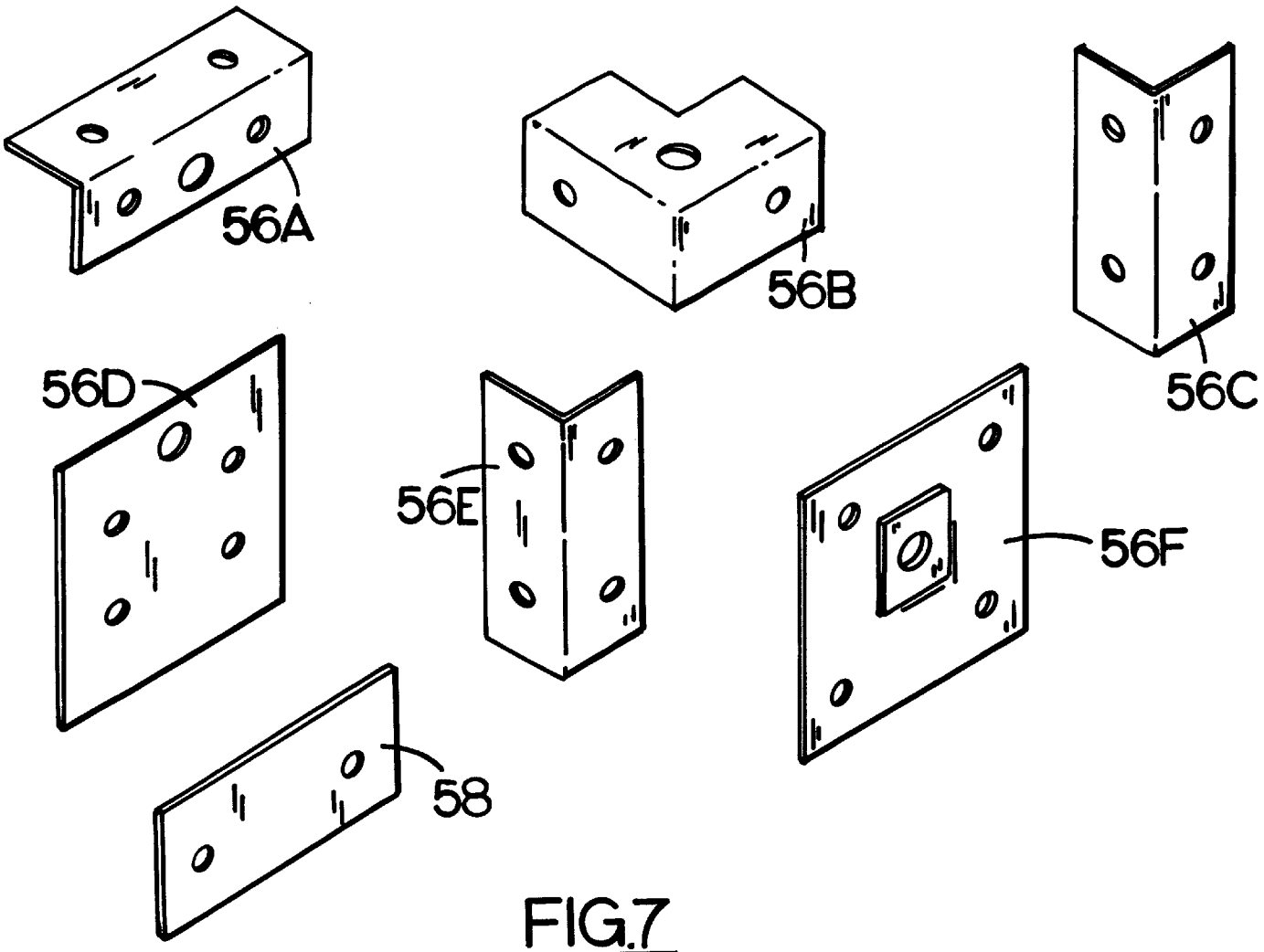
FIG. 7 shows various brackets used with a floating structure made with the modules of this invention.
Figure 8:
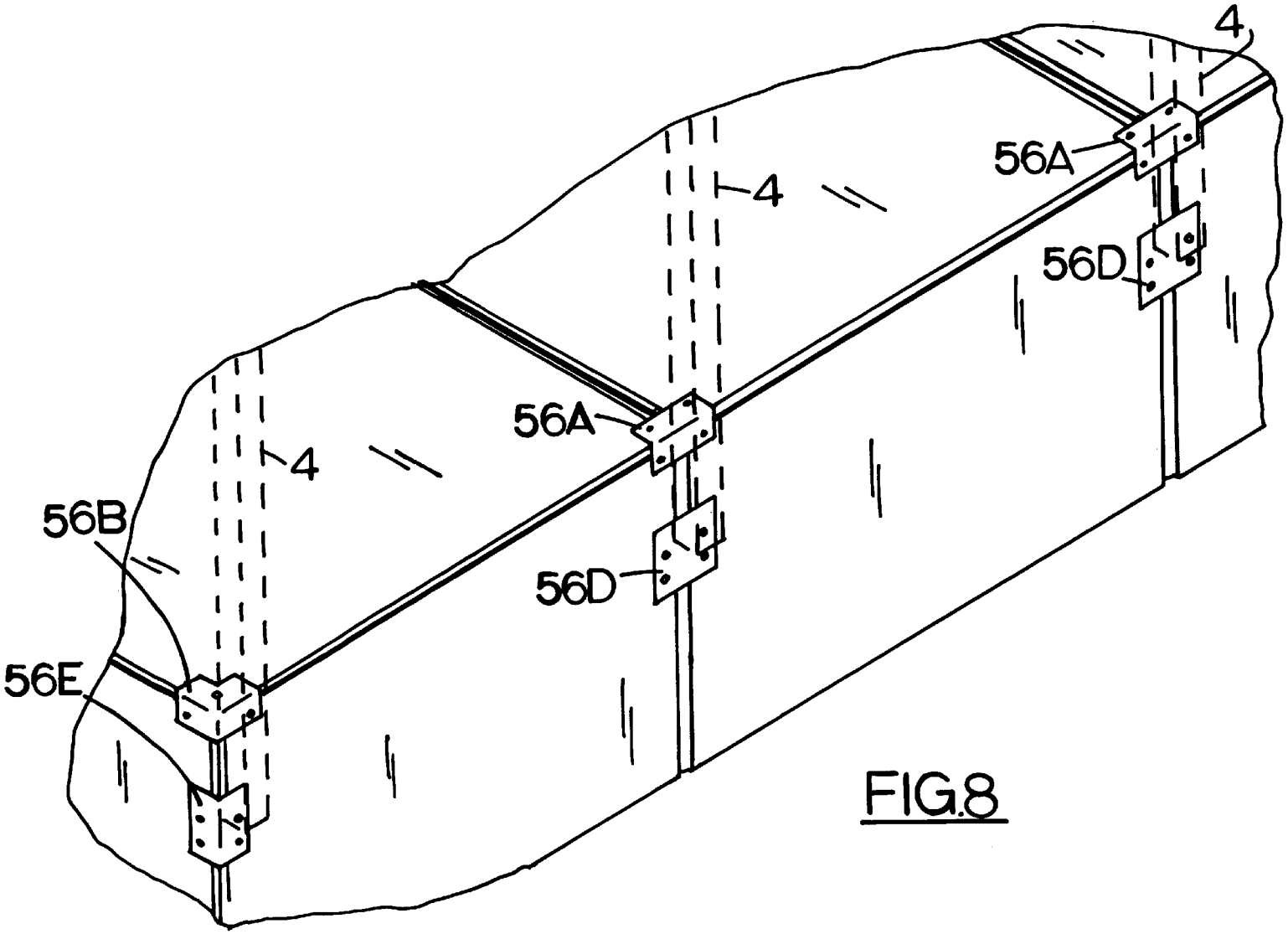
FIG. 8 shows interconnected modules and brackets being used in a typical installation.

Other type of brackets 56 are available for attaching posts, buildings, rails, cleats and any other item. FIG. 7, shows a variety of brackets 56 referenced as 56 A–F and 58. Refer to FIGS. 4 and 8 as typical representations of the location of the brackets 56. An upper side post bracket 56A is used for attaching a post 4 along the side of the floating structure 6. A lower side post bracket 56D is used in conjunction with the upper side post bracket 56A. The two brackets together 56A and 56D provide a very secure method of attaching a post. In the corners, an upper corner post bracket 56B and a lower corner post bracket 56E are used for attaching a post 4 at the corners. Again the two brackets used in conjunction provides a very secure means of attaching a post 4 to a corner of a floating structure 6. A basic corner bracket 56C is used at the ends of the floating structures 6. This bracket is similar to bracket 58 in that it provides protection to the concrete from the nut 54 on the interconnecting means 50. When attaching a roof or other structure, a post 4 is often positioned on the top surface of the floating structure 6. In these situations, bottom plate bracket 56F is provided. The post 4 is attached to the top surface of bracket 56F and the bracket is attached to the top surface of the modules 10.

The brackets 56A–F and 58 are all attached to the modules 10. The brackets 56 and 58 all have specifically positioned holes used for attaching the brackets to the modules 10. Brackets 56 C, D, E and 58 have holes which align with passages 20 and 24. As such, these brackets are attached in conjunction with the interconnecting means 50. They provide protection to the concrete shell 14 and add strength to the structure at those locations. Brackets 56A, B, and 56F have holes which are used with anchor bolts or concrete screws. Typically, the concrete shell 14 would be pre-drilled to receive the screws or anchor bolts.

In addition, the modules 10 may be provided with side grooves 46. Side grooves 46, if used, are located along all sides of the module 10 parallel to and below the top surface of the module 10 and above the first plane 22. Grooves 46 of abutting modules 10 in a floating structure 6 forms a passage or channel, also referenced as 46, along and through abutting modules 10. The passage 46 receives a threaded rod 48 for attaching brackets 56 to the sides of the floating structure. The threaded rod 48 would extend through the abutting modules and out both sides of the length or width of the structure, as appropriate. A bracket 56 with a corresponding hole would be secured to one end with a nut. The other end of the threaded rod 48 would be secured with another bracket 56 or with a washer and nut, in accordance with the particulars of the floating structure. The threaded rod provides additional holding capacity and strength to the brackets 56 and anything attached thereto.

Construction of the Modules

The module 10, as discussed above in the preferred embodiment, is a buoyant core 12 covered with a concrete shell 14. The buoyant core 12 is made from a block of expanded polystyrene 30. The buoyant core 12 is generally cut from a bulk block of expanded polystyrene. Typically two or more buoyant cores 12 can be cut from a single bulk block. The buoyant core 12, in the preferred embodiment as discussed above, will be cut into the proper dimensions with notches 32, grooves 42 and 44, chamfered corners 38 and tapered top portion 40. The block can be cut using any method. However, using a heated wire cutting tool has proven very satisfactory. It accurately cuts the polystyrene without waste flying all over the place.

Concrete forms of all sort are known and used throughout any operation using concrete. Concrete is poured into a form so the concrete will acquire the shape on the inside of the form. As the concrete hardens and sets the forms are removed. The concrete is then allowed to continue to cure and dry. Once cured the concrete structure can be used as intended. This method of forming concrete is old and has been known in the art almost as long as concrete has been used.

The modules 10 in accordance with this invention also uses forms to form the concrete shell 14. Typically the form used will be a box like structure having four sides and a bottom. The forms, in accordance with the preferred embodiment, are made with a steel frame having corner holding pins. The actual sides of the form, which hold the concrete, can be made of wood, steel or any other strong, durable and flat material.

In the past, other modules have been made using similar techniques. However, what makes this construction method unique is the formation of modules 10 that may have one or more side of the module 10 having a concave surface 28. In order to do this, the center of the sides of the forms are bowed inward to create the concave surface 28. This is accomplished by a bowed frame member or a spacer added between a center brace of the frame and the flat material making up the sides of the form.

Previously there were no provisions for having a concaved surface 28 on a floating concrete module, nor is there any similar sort of feature in any of the known art. Typically, the forms had flat sides and because of the weight of the concrete the side would slightly bend outward near the center. As the concrete set and dried, a convex surface would be formed. As discussed above, this creates many undesirable features. In addition, if the forms did not have knock out corners, it would be very difficult to remove the module from the form. The holding pins, as used with the forms of this invention and the bowed inward side surface 28, makes the forms very easy to remove. The holding pins holds the corners of the forms together, such that as the pins are removed the side drop away from one another so the module 10 can be easily removed.

Once the buoyant core 12 is cut and the forms are assembled, the lightweight concrete is mixed. As discussed above and in the preferred embodiment, a light weight reinforced concrete is made using a light weight expanded shale aggregate and reinforced by mixing the concrete with a fibrillated fiber made with polypropylene. A layer of the light weight concrete, of the desired thickness, is poured into the bottom of the assembled form. The buoyant center core 12 is placed in the form on top of the layer of concrete. The passage forming rods are positioned through proper positioned holes in the sides of the forms, which correspond to the location of grooves 42 and 44 in the buoyant core 12. Reinforcing rods 34 are positioned in notches 32, if used. Then the concrete is poured into the form, around the sides and top of the buoyant core 12. The entire apparatus may be vibrated to settle the concrete and to fill any voids. Excess is removed and the top of the module 10 being formed is troweled and/or finished to the desired texture. As the concrete sets, the passage forming rods are removed. The rods are rotated and pulled back and forth to smooth the inside surface of the passages being formed. Once the concrete is properly set, the holding pins are removed and the forms are taken off the module 10. Once the concrete is completely dried, the module 10 is ready for use.

If side grooves 46 are being incorporated on the module, the inside of the form panels would also contain a half circle raised ridge parallel to the top edge, at the appropriate location or height. The ridge would provide for and form the sides grooves 46 as the concrete is poured into the form and the concrete sets. Since the forms utilize holding pins, the form panels are easily removed.

The modules 10 can be built in a factory where conditions can be controlled or can be made at the job site. In the preferred embodiment, the modules 10 are constructed in a controlled environment. This has proven to produce quality modules on a consistent basis. However, for one reason or another, the modules 10 can be made where ever desired. The buoyant core 12 can be formed at one location and the concrete shell 14 at another or they both can be formed at the same location.

Construction of Floating Structure

The modules 10 because of their size and weight, can be easily transported by truck. They can also be maneuvered and moved using fork lifts or skid loaders. At the job site, the modules 10 are placed in the water. A plurality of the modules 10, as dictated by the desired configuration, are positioned in line. This would include any modules 10, including the basic module 10A, triangular modules 10 B, smaller dimensioned modules or modules with increase heights 10C. The interconnecting means 50, a rod 52 in the preferred embodiment, is inserted through the passages 20 or 24 in the plurality of modules 10. A nut 54 would typically be placed on one end of the rod 52 to prevent the rod 52 from being pulled from the modules as other modules are added. Once the line is formed a second nut 54 would be added to prevent the modules from separating. A second line would be similarly constructed along side the first. After the second line is assembled, the interconnecting means 50 can be inserted through the second set of passages 24 to interconnect the modules 10 in the other direction. Modules 10 are then added to form the desired configuration.

At the intersection of the abutting modules 10, where no structure or other item is to be attached, bracket 58 is added and attached in conjunction with the interconnecting means 50. At the corners where no structure is positioned or no other item is to be attached, bracket 56C is added in conjunction with the interconnecting means 50. At corners or the intersection of two modules 10 where posts 4 are required, brackets 56E and 56D will be installed in conjunction with the interconnecting means 50.

Once all the modules 10 are positioned and attached, the interconnecting means 50 can be completely tightened. Using rods 52 with threaded ends makes this task very easy. The nuts 54 are simply tightened to draw the modules 10 together. Any excess rod 52 extending beyond the nuts 54 can be trimmed using a hack saw or other tool. Brackets 56 A, B and F can then be added where needed. Typically these will be located in accordance where support posts 4 will be located. Once positioned, holes are drilled into the concrete shell 14. Then anchor bolts or screws are used to secure the brackets in position. At locations where brackets 56 are used, the brackets can have a hole for attachment of the bracket to the threaded rod 48 which is extending from passage 46 at the junction of adjoining modules 10. As indicated above the threaded rod 48 adds stability and holding strength to the brackets and any item attached thereto.

Having described the invention in detail, those skilled in the art will appreciate that modifications may be made of the invention without departing from the spirit of the inventive concept herein described.

Therefore, it is not intended that the scope of the invention be limited to the specific and preferred embodiments illustrated and described. Rather, it is intended that the scope of the invention be determined by the appended claims and their equivalents.

What is claimed is:

1. A concrete module for assembling floating structures comprising:

a module having a buoyant core surrounded by a concrete shell, said module having a top, at least three sides and a bottom, with a plurality of said modules adapted to being interconnected to form a floating structure;

a plurality of reinforcing ribs within said top of said module;

a concave surface on one or more sides of said modules such that an outer perimeter area of said sides of said module can butt against an outer perimeter area of a side of an adjoining module without a center area on abutting modules contacting each other;

one or more first passages for receiving a first interconnecting device through said module in a first plane, said first plane below and parallel to a top surface of said top of said module, said first plane being above a water line when said module is floated in water; and one or more second passages, for receiving a second interconnecting device, through said module along a second plane in which said passages are in a different direction than said first passages in said first plane, said second plane also being parallel with said first plane and also being above said water line.

2. The concrete module as set forth in claim 1 in which said buoyant core is made with a block of expanded polystyrene.

3. The concrete module as set forth in claim 1 in which said buoyant core is surrounded with a light weight reinforced concrete to form said concrete shell.

4. The concrete module as set forth in claim 1 in which said buoyant core has at least two notches in a top surface of said buoyant core, said notches receiving reinforcing rods and then filled with concrete to produce said reinforcing ribs.

5. The concrete module as set forth in claim 4 in which at least two of said notches are perpendicular to one another.

6. The concrete module as set forth in claim 1 in which said buoyant core has chamfer corners and a tapered upper portion along sides of said buoyant core, said chamfer corners and tapered side portion providing extra strength for said concrete shell.

7. The concrete module as set forth in claim 1 in which said buoyant core has grooves along said sides, said grooves providing a path for forming said first and second passages.

8. The concrete module as set forth in claim 1 in which said first plane and said second plane are parallel non-intersecting planes above a waterline when said module is floated in water.

9. The concrete module as set forth in claim 1 further claiming a plurality of brackets, said brackets used to attach items and other structures to a floating structure made with said concrete modules, and to provide protection of said concrete shell and add strength to said floating structure.

10. The concrete module as set forth in claim 1 further claiming side grooves on sides of said modules below and parallel to a top surface of said module, said side grooves forming a passage along a junction of abutting modules, said passage formed by said side grooves receiving a threaded rod which extends through said passage for attachment of a bracket.

11. A concrete module for assembling floating structures comprising:

a buoyant core, said buoyant core having a tapered upper portion along sides of said buoyant core, one or more notches in a top surface of said buoyant core, grooves parallel with said top surface along one or more sides of said buoyant core and said buoyant core having one or more chamfer corners;

a concrete shell surrounding said buoyant core to form a concrete module;

one or more passages through said module with said passages corresponding to said grooves in said module, with at least one of said passages in each of two non-common planes, both of said planes being parallel with a top surface of said module and above a water line when said module is floated in water; and an interconnecting means extending through said passages to join a plurality of said modules together to form a floating structure.

12. The concrete module as set forth in claim 11 in which said buoyant core is formed from expanded polystyrene.

13. The concrete module as set forth in claim 11 in which said concrete shell is made with a lightweight reinforced concrete.

14. The concrete module as set forth in claim 11 in which said concrete shell is made using concrete with an expanded shale aggregate.

15. The concrete module as set forth in claim 11 in which said concrete shell is made with concrete reinforced with a fibrillated fiber made with polypropylene.

16. The concrete module as set forth in claim 11 further claiming one or more concaved surfaces on one or more sides of said module, said concaved sides providing a means for said modules to abut one another along outer perimeter of said sides of said module.

17. The concrete module as set forth in claim 11 further claim one or more reinforcing ribs, said reinforcing rib being made with a reinforcing rod and concrete within said notches in said top surface of said buoyant core, said reinforcing rib being continuous and integrated with said concrete shell to provide extra strength to said top surface of said module.

18. The concrete module as set forth in claim 11 further claiming side grooves on sides of said modules below and parallel to said top surface of said module, said side grooves forming a passage along a junction of abutting modules, said passage receiving a threaded rod which extends through said passage for attachment of a bracket.

19. The concrete module as set forth in claim 11 in which said interconnecting means comprises a rod with threaded ends, said rod extending through said passages to interconnect and join a plurality of modules together to form a floating structure, and nuts on said threaded ends to secure said modules to said interconnecting means.

20. The concrete module as set forth in claim 11 further claiming a plurality of different shaped brackets, said brackets provided for attaching other structures and items to said floating structure made with said module, for providing protection to said modules at said passages and to add strength to said floating structure at an intersection between two of said modules.

21. A concrete module for floating structure comprising:

a buoyant core, said buoyant core having a top, at least three sides, and a bottom with a tapered upper portion along said sides of said buoyant core, one or more notches in a top surface of said buoyant core, grooves along one or more sides within two parallel non-common planes through said buoyant core and said buoyant core having one or more chamfered corners;

a concrete shell surrounding said buoyant core to form a concrete module, said concrete shell made with a lightweight reinforced concrete;

one or more reinforcing ribs integrated within said concrete shell at a top side of said module, said reinforcing rib constructed by said concrete being within said notches on said top surface of said buoyant core, said reinforcing rib providing extra strength for said top of said module;

a concave surface on one or more sides of said module such that an outer perimeter area of said side of said module can butt against an outer perimeter area of said side of an adjoining module without a center area on abutting modules contacting each other; and one or more passages through said module, said passages corresponding to a position with said grooves on said sides of said buoyant core, with at least one of said passages in each of said two non-common planes, both of said planes being parallel with a top surface of said module and above a waterline when said module is floated in water; whereby an interconnecting means can extend through said passages to join a plurality of said modules together to form a floating structure.

22. The concrete module as set forth in claim 21 in which said concrete shell is made using a concrete with light weight expanded shale aggregate.

23. The concrete module as set forth in claim 21 in which said concrete shell is made with concrete reinforced with a fibrillated fiber.

24. The concrete module as set forth in claim 21 in which said reinforcing rib further comprises a reinforcing rod contained within said concrete and within said notches in said buoyant core.

25. The concrete module as set forth in claim 21 further claiming one or more brackets, said brackets providing a means to attach other structure and items to said floating structure made with said modules, to provide protect to said concrete shell on said module at openings to said passage and which are used in conjunction with said interconnecting means, and to provide strength at an intersection of two modules.

26. The concrete module as set forth in claim 21 further claiming side grooves on sides of said modules below and parallel to said top surface of said module, said side grooves forming a passage along and through a junction of abutting modules, said passage receiving a threaded rod which extends through said passage for attachment of a bracket to said abutting modules.

* * * * *